US009896940B2

(12) United States Patent
Boeck et al.

(10) Patent No.: US 9,896,940 B2
(45) Date of Patent: Feb. 20, 2018

(54) BLADE FOR A GAS TURBOMACHINE

(71) Applicant: MTU Aero Engines AG, Munich (DE)

(72) Inventors: Alexander Boeck, Kottgeisering (DE); Norbert Huebner, Dachau (DE); Sven Schmid, Munich (DE)

(73) Assignee: MTU Aero Engines AG, Munich (DE)

( * ) Notice: Subject to any disclaimer, the term of this patent is extended or adjusted under 35 U.S.C. 154(b) by 532 days.

(21) Appl. No.: 14/325,560

(22) Filed: Jul. 8, 2014

(65) Prior Publication Data

US 2015/0017011 A1 Jan. 15, 2015

(30) Foreign Application Priority Data

Jul. 9, 2013 (DE) ..... 10 2013 213 416

(51) Int. Cl.
*F01D 5/14* (2006.01)
*F01D 5/22* (2006.01)

(52) U.S. Cl.
CPC ..... *F01D 5/147* (2013.01); *F01D 5/141* (2013.01); *F01D 5/225* (2013.01); *F05D 2240/304* (2013.01)

(58) Field of Classification Search
CPC ..... F01D 5/141; F01D 5/147; F01D 5/225; F05D 2240/122; F05D 2240/304
See application file for complete search history.

(56) References Cited

U.S. PATENT DOCUMENTS

2004/0062636 A1 4/2004 Mazzola et al.
2005/0111978 A1 5/2005 Strohl et al.
2007/0177979 A1* 8/2007 Hoeger ..... F01D 5/145 416/193 A
2009/0013532 A1* 1/2009 Wood ..... F01D 5/141 29/889.7
2010/0202889 A1* 8/2010 Klingels ..... B23H 9/10 416/223 A
2013/0177395 A1* 7/2013 Ikeda ..... F24F 1/0025 415/53.1
2013/0236319 A1* 9/2013 Rockarts ..... F01D 5/141 416/223 R

FOREIGN PATENT DOCUMENTS

WO WO 2012063404 A1 * 5/2012 ..... F24F 1/0025

* cited by examiner

*Primary Examiner* — Woody Lee, Jr.
*Assistant Examiner* — Jesse Prager
(74) *Attorney, Agent, or Firm* — Davidson, Davidson & Kappel, LLC

(57) ABSTRACT

A blade, in particular a rotor blade or a stator vane, for a gas turbomachine, in particular a turbojet engine, the blade having an airfoil (1) for deflecting a flow of working fluid and a first platform (3) connected thereto, in particular integrally connected thereto, to radially bound a flow duct for the working fluid, the airfoil having a suction side and a pressure side (1.1) which are connected at a leading edge (1.2) and at a trailing edge (1.3). The trailing edge has a first minimum wall thickness in a first region (A) of a radial longitudinal extent (R) of the airfoil proximal to the first platform (3), and a maximum wall thickness that is smaller than the first minimum wall thickness in a platform-distal region (C) of the radial longitudinal extent.

15 Claims, 1 Drawing Sheet

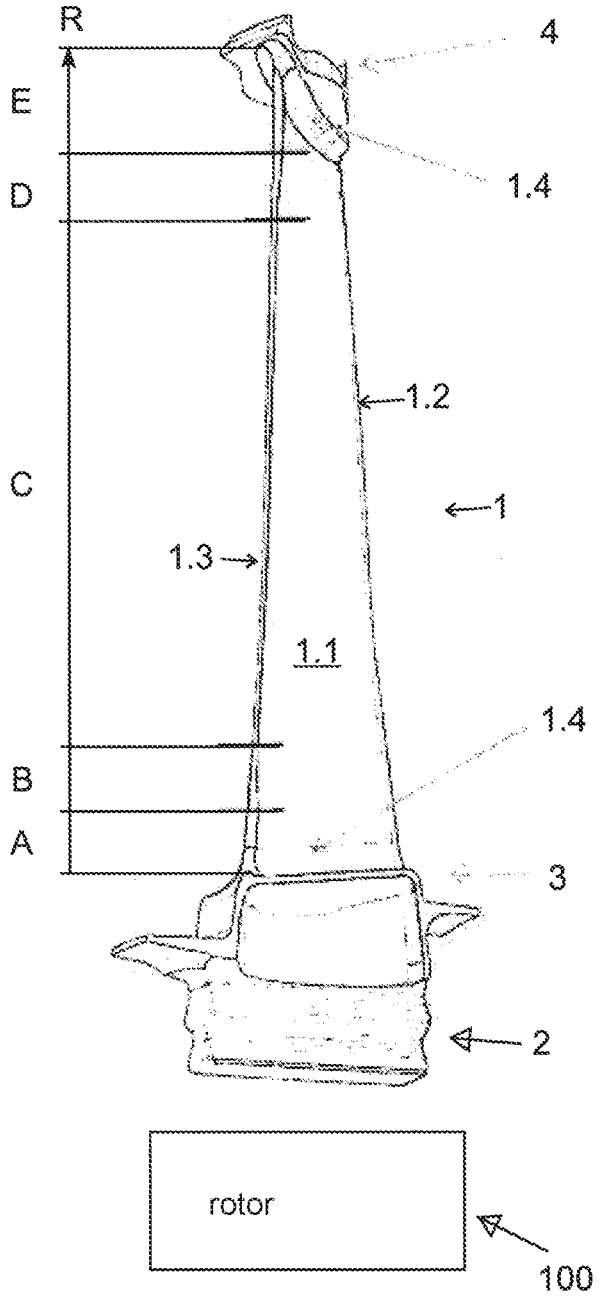
R
E
D
C
B
A
4
1.4
1.2
1
1.3
1.1
1.4
3
2
rotor
100

BLADE FOR A GAS TURBOMACHINE

This claims the benefit of German Patent Application DE 102013213416.9, filed Jul. 9, 2013 and hereby incorporated by reference herein.

The present invention relaters to a blade, in particular a rotor blade or a stator vane, for a gas turbomachine, and a gas turbomachine having such a rotor blade.

BACKGROUND

Rotor blades and stator vanes of compressor and turbine stages of gas turbomachines generally have an airfoil for deflecting a flow of working fluid, the airfoil having a suction side and a pressure side which are connected at an upstream leading edge, which receives the flow of working fluid during operation, and at an axially opposite, downstream trailing edge.

SUMMARY OF THE INVENTION

It is an object of an embodiment of the present invention to provide an advantageous gas turbomachine.

The present invention provides a gas turbomachine, in particular a turbojet engine, including one or more compressor stages and/or one or more turbine stages having a plurality of rotor blades which are arranged side-by-side in a circumferential direction and detachably or permanently, in particularly integrally, connected to a rotor of the gas turbomachine, and which each have an airfoil for deflecting a flow of working fluid of the gas turbomachine in order to impart energy thereto or extract energy therefrom. Axially upstream and/or downstream of rotor blades, there may be provided a plurality of stator vanes which are arranged side-by-side in a circumferential direction and detachably or permanently, in particularly integrally, connected to a (part of the) casing of the gas turbomachine, and which each have an airfoil for deflecting a flow of working fluid of the gas turbomachine, in particular to convert kinetic energy into pressure energy or vice versa. The present invention and the description hereafter refer to both rotor blades and stator vanes.

The airfoil has a suction side, in particular a convex suction side, and a pressure side, in particular a concave pressure side, which are connected at an upstream or axially forward leading edge, which receives the flow of working fluid during operation, and at an axially opposite or rear downstream trailing edge. In an embodiment, the airfoil includes airfoil sections, whose center points or centroids are stacked along a so-called stacking axis, as viewed in a radial direction. The stacking axis may be oriented parallel to a radius on an axis of rotation of the gas turbomachine. In another embodiment, it may be inclined with respect to the radius in an axial direction and/or a circumferential direction. The stacked profile sections may be aligned with each other or rotated relative to each other about the stacking axis or a radius on the axis of rotation. In one embodiment, the trailing edge may be at least substantially circular-segment-shaped, in particular at least substantially semicircular in shape, in at least one profile section. It may also be elliptical-segment-shaped, in particular at least substantially semielliptical in shape. In one embodiment, the trailing edge may be at least substantially straight in at least one profile section.

Connected to the airfoil is a first platform which radially bounds a flow duct for the working fluid of the gas turbomachine. The first platform may be located at the radially inner or radially outer end of the airfoil. In a refinement, a second platform radially opposite the first platform is also connected to the airfoil to radially bound the flow duct. The second platform may accordingly be located at the radially outer or radially inner end of the airfoil.

In an embodiment, one or two opposite platforms may be formed integrally with the airfoil, in particular formed together therewith by primary and/or secondary shaping. One or two opposite platforms may also be formed separately and subsequently connected to the airfoil, preferably permanently and in particular by a material-to-material bond, specifically by welding.

In accordance with an aspect of the present invention, a wall thickness of the trailing edge of the airfoil varies in the direction of a radial longitudinal extent of the airfoil or in the direction of a radius on an axis of rotation of the gas turbomachine. In a region of the longitudinal extent that is farther from one or two opposite platforms and will therefore be referred to hereinafter as platform-distal region, in particular in a middle region of the longitudinal extent, the wall thickness is thinner than in one or two opposite platform-proximal regions.

In an embodiment, this makes it possible to improve flow-off in the platform-distal region, in particular to reduce a wake region, and thereby reduce flow losses at the trailing edge, without any mechanical and/or thermal stress peaks being induced at the transition of such a thin trailing edge into the preferably more massive platform(s).

Accordingly, in accordance with an aspect of the present invention, the trailing edge has a first minimum wall thickness in a first region of the radial longitudinal extent of the airfoil proximal to the first platform. In a platform-distal region of the radial longitudinal extent, the trailing edge has a maximum wall thickness that is smaller than the first minimum wall thickness. In one embodiment, the trailing edge has a second minimum wall thickness greater than the maximum wall thickness also in a second region of the radial longitudinal extent proximal to the second platform. Thus, in the platform-distal region, flow-off can be improved by the smaller maximum thickness while at the same time reducing stress in the platform-proximal region(s) due to an abrupt material change into the platform(s).

In one embodiment, in order to further reduce stress, the wall thickness of the trailing edge varies continuously from the minimum wall thickness of a platform-proximal region to the maximum wall thickness of the platform-distal region in a transition region of the radial longitudinal extent between the region proximal to the first platform and the platform-distal region and/or in a transition region between the region proximal to the second platform and the platform-distal region. The term "continuous transition", as used herein, is understood to refer in particular to a stepless transition. Additionally or alternatively, the wall thickness may vary monotonically in the transition region. As is customary in the art, this is understood to mean that at any position along the radial longitudinal extent of the transition region that is closer to a platform, the wall thickness is at least equal to the wall thickness at any position of the transition region that is farther from a platform. In a refinement, the wall thickness varies strictly monotonically in transition region. As is customary in the art, this is understood to mean that at any position along the radial longitudinal extent of the transition region that is closer to a platform, the wall thickness is greater than the wall thickness at any position of the transition region that is farther from a platform. This makes it possible to create a smooth transition between the platform-distal region and the platform-proximal region(s).

In an embodiment, in particular in the platform-distal region, the wall thickness of the trailing edge may be at least substantially constant and accordingly equal to the maximum wall thickness. In contrast, in one or two opposite platform-proximal regions, the wall thickness of the trailing edge may in an embodiment be constant or increase from the minimum wall thickness toward the platform, especially if, in a refinement, the trailing edge of the airfoil merges into the platform(s) in an in particular concavely curved corner or rounding.

If the trailing edge is at least substantially circular-segment-shaped, in particular at least substantially semicircular in shape, in a profile section, then the chord length of this circular segment, in particular the diameter of this semicircle, may define the wall thickness of the trailing edge in this profile section; i.e., in this radial position along the radial longitudinal extent, in the context of the present invention. If the trailing edge is at least substantially elliptical-segment-shaped, in particular at least substantially semielliptical in shape, in a profile section, then the chord length of this elliptical segment, in particular the major or minor axis of this semi ellipse, may define the wall thickness of the trailing edge in this profile section; i.e., in this radial position along the radial longitudinal extent, in the context of the present invention. If the trailing edge is at least substantially straight in a profile section, then the length of this straight trailing edge may define the wall thickness of the trailing edge in this profile section; i.e., in this radial position along the radial longitudinal extent, in the context of the present invention. In one embodiment, the wall thickness of the trailing edge may be defined to be the maximum thickness of the airfoil in a region extending no more than 5%, in particular no more than 2%, from the axially rear end of the airfoil in the upstream direction; i.e., axially toward the leading edge.

Surprisingly, it has been found that particularly favorable flow-off conditions are obtained when a maximum wall thickness of the trailing edge in the platform-distal region is no greater than 0.45 mm, in particular no greater than 0.40 mm, and preferably no greater than 0.35 mm. Moreover, it has been found that particularly favorable loading conditions are obtained when a minimum wall thickness of the trailing edge in one or two opposite platform-proximal regions is at least 0.35 mm, in particular at least 0.40 mm, and preferably at least 0.45 mm.

It has also surprisingly been found that a reduction in the thickness of the trailing edge over a length of at least 50% of the radial longitudinal extent already produces favorable flow-off conditions, that a reduction in thickness over a length of at least 60% produces significantly more favorable conditions, whereas a reduction in thickness of more than 80% in an embodiment does not result in any significant additional improvement. Therefore, in one embodiment of the present invention, the platform-distal region extends over at least 25%, in particular at least 30%, of the radial longitudinal extent from a middle of the radial longitudinal extent of the airfoil toward at least one platform-proximal region. The platform-distal region may extend from the middle of the radial longitudinal extent symmetrically or asymmetrically toward two opposite platform-proximal regions and, in one embodiment, may be at least 50% (=2×25%), in particular at least 60% (=2×30%), of the radial longitudinal extent. Additionally or alternatively, the platform-distal region may, in one embodiment of the present invention, extend over no more than 40%, in particular no more than 35%, of the radial longitudinal extent from the middle of the radial longitudinal extent of the airfoil toward a platform-proximal region and, in one embodiment, may accordingly be no more than 80% (=2×40%), in particular no more than 70% (=2×35%), of the radial longitudinal extent.

For a platform-proximal region, an extent of no more than 10%, in particular no more than 5%, of the radial longitudinal extent in a direction away from a platform has been found to be particularly advantageous. For a transition region between a platform-proximal region and the platform-distal region, an extent of at least 5%, in particular at least 10%, of the radial longitudinal extent and/or an extent of no more than 20%, in particular at least 15%, of the radial longitudinal extent has been found to be particularly advantageous.

Further advantageous features of the present invention will be apparent from the dependent claims and the following description of preferred embodiments.

BRIEF DESCRIPTION OF THE DRAWING

FIG. 1 shows, in partially schematic form, a rotor blade of a gas turbomachine according to an embodiment of the present invention.

DETAILED DESCRIPTION

The invention will now be described in more detail using the example of a rotor blade that constitutes a preferred embodiment of the present invention. As mentioned earlier herein, a stator vane is another preferred embodiment of the present invention. The explanations given below apply analogously to a stator vane.

FIG. 1 shows, in a perspective view, a rotor blade of a compressor or turbine stage of a gas turbomachine in the form of a turbojet engine according to an embodiment of the present invention. This rotor blade is detachably connectable to a rotor 100 (shown schematically) of the gas turbomachine by means of a fir-tree blade root 2.

An airfoil 1 of the rotor blade has a convex suction side and a concave pressure side 1.1, which are connected at an upstream or axially forward leading edge 1.2 (on the right in FIG. 1), which receives the flow of working fluid of the turbine during operation, and at an axially opposite or rear downstream trailing edge 1.3 (on the left in FIG. 1), Connected to the airfoil 1 at its radially inner end is a first platform 3 which radially bounds a flow duct for the working fluid of the gas turbomachine. A radially outer second platform 4 radially opposite the first platform is also connected to the airfoil 1 to radially bound the flow duct. The airfoil, in particular its trailing edge, merges into the platforms 3, 4 in a rounding 1.4.

Trailing edge 1.3 has a first minimum wall thickness in a first region A of the radial longitudinal extent R (vertical in FIG. 1) of the airfoil proximal to the first platform 3. In a platform-distal region C of the radial longitudinal extent, the trailing edge has a maximum wall thickness that is smaller than this first minimum wall thickness. Trailing edge 1.3 has a second minimum wall thickness greater than the maximum wall thickness also in a second region E of the radial longitudinal extent R proximal to the second platform 4. Thus, in the platform-distal region C, flow-off can be improved by the smaller maximum thickness while at the same time reducing stress in the platform-proximal regions A, E due to an abrupt material change into the platform 3, respectively 4.

In order to further reduce stress, the wall thickness of trailing edge 1.3 varies continuously from the minimum wall thickness of a platform-proximal region to the maximum wall thickness of the platform-distal region in a transition region B of the radial longitudinal extent between the region A proximal to first platform 3 and the platform-distal region C and in a transition region D between the region E proximal to second platform 4 and the platform-distal region C. In platform-distal region C, the wall thickness of trailing edge 1.3 is at least substantially constant. In the two opposite platform-proximal regions A, E, the wall thickness of trailing edge 1.3 is substantially constant up to the beginning of the rounding where the airfoil merges into platform 3, respectively 4.

The substantially constant wall thickness, and thus the maximum wall thickness, of trailing edge 1.3 in platform-distal region C is about 0.3 mm. The substantially constant wall thickness of the trailing edge in the two opposite platform-proximal regions A, E is about 0.5 mm. Platform-distal region C extends symmetrically from a middle of the radial longitudinal extent R of airfoil 1 toward both platform-proximal regions A, E over at least about 32% of the radial longitudinal extent, and accordingly is about 64% of the radial longitudinal extent. Platform-proximal regions A, E extend over about 3% of the radial longitudinal extent in directions away from platform 3, respectively 4. Accordingly, transition regions B, D extend over about 15% of the radial longitudinal extent between the platform proximal regions and the platform-distal region.

Although the above is a description of exemplary embodiments, it should be noted that many modifications are possible. It should also be appreciated that the exemplary embodiments are only examples, and are not intended to limit scope, applicability, or configuration in any way. Rather, the foregoing description provides those skilled in the art with a convenient road map for implementing at least one exemplary embodiment, it being understood that various changes may be made in the function and arrangement of elements described without departing from the scope of protection set forth in the appended claims and their equivalent combinations of features.

LIST OF REFERENCE NUMERALS

1 airfoil
1.1 pressure side
1.2 leading edge
1.3 trailing edge
1.4 rounding (curved corner)
2 blade root
3 first/inner platform
4 second/outer platform (outer shroud)
100 rotor
A/E first/second platform-proximal region
B, D transition region
C platform-distal region
R radial longitudinal extent

What is claimed is:

1. A blade for a gas turbomachine, the blade comprising:
an airfoil for deflecting a flow of working fluid;
a first platform connected thereto to radially bound a flow duct for the working fluid,
the airfoil having a suction side and a pressure side connected at a leading edge and at a trailing edge, the trailing edge having a first minimum wall thickness in a first region of a radial longitudinal extent of the airfoil proximal to the first platform, and a maximum wall thickness smaller than the first minimum wall thickness in a platform-distal region of the radial longitudinal extent; and
a second platform radially opposite the first platform being connected to the airfoil to radially bound the flow duct, the trailing edge having a second minimum wall thickness greater than the maximum wall thickness in a second region of the radial longitudinal extent proximal to the second platform,
the maximum wall thickness of the trailing edge in the platform-distal region being no greater than 0.35 mm,
wherein each of the first and second platform proximal regions extends over 10% of the radial longitudinal extent in a direction away from a platform;
wherein the platform-distal region extends over at least 25% of the radial longitudinal extent from a middle of the radial longitudinal extent of the airfoil toward a platform-proximal region,
wherein the wall thickness of the trailing edge is equal to a maximum wall thickness of the airfoil in a region which extends by 5% from an axially rear end of the airfoil in the upstream direction toward the leading edge,
whereby the maximum wall thickness of the trailing edge in the platform distal region is at least substantially constant,
wherein the wall thickness of the trailing edge decreases strictly monotonically respectively, from the minimum wall thickness of the respective platform-proximal region to the maximum wall thickness of the platform-distal region in a transition region of the radial longitudinal extent between the first and second platform-proximal region and the platform-distal region, and
wherein the transition regions extend respectively over 10% of the radial longitudinal direction.

2. The blade as recited in claim 1 wherein the first or the second minimum wall thickness is at least 0.35 mm.

3. The blade as recited in claim 1 wherein the first or the second minimum wall thickness is at least 0.40 mm.

4. The blade as recited in claim 1 wherein the first or the second minimum wall thickness is at least 0.45 mm.

5. The blade as recited in claim 1 wherein the platform-distal region extends over at least 25 and no more than 30% of the radial longitudinal extent from a middle of the radial longitudinal extent of the airfoil toward the first or the second platform.

6. The blade as recited in claim 1 wherein the trailing edge of the airfoil merges into a platform in a corner.

7. The blade as recited in claim 6 wherein the corner is concavely curved.

8. A rotor blade comprising the blade as recited in claim 1.

9. A stator vane comprising the blade as recited in claim 1.

10. A turbojet engine comprising the blade as recited in claim 1.

11. The blade as recited in claim 1 wherein the airfoil and the first platform are integrally connected.

12. The blade as recited in claim 1 wherein the airfoil and the second platform are integrally connected.

13. A gas turbomachine comprising at least one compressor stage or at least one turbine stage having at least one blade as recited in claim 1, the at least one blade being detachably or permanently connected to a rotor of the gas turbomachine.

14. The gas turbomachine as recited in claim 13 wherein the blade is integrally connected to the rotor.

15. A turbojet engine comprising the gas turbomachine as recited in claim 13.

* * * * *